United States Patent [19]

Oowada

[11] 4,450,604

[45] May 29, 1984

[54] BUCKLE FOR SEAT BELT

[75] Inventor: Tetsuya Oowada, Ichikawa, Japan

[73] Assignees: Nippon Kinzoku Co., Ltd.; NSK Warner Kabushiki Kaisha, both of Tokyo, Japan

[21] Appl. No.: 421,374

[22] Filed: Sep. 22, 1982

[30] Foreign Application Priority Data

Nov. 4, 1981 [JP] Japan ..... 56-176889

[51] Int. Cl.[3] ..... A44B 11/00; A44B 11/08; A44B 11/20

[52] U.S. Cl. ..... 24/652; 24/664

[58] Field of Search ..... 24/230 AK, 230 AS, 230 A, 24/230 AP, 230 TC, 230 AL, 230 R

[56] References Cited

U.S. PATENT DOCUMENTS

| | | | |
|---|---|---|---|
| 3,409,949 | 11/1968 | Kobrehel et al. | 24/230 R |
| 3,449,800 | 6/1969 | Fisher | 24/230 R |
| 3,453,699 | 7/1969 | Smith et al. | 24/230 R |
| 3,883,932 | 5/1975 | Meiller et al. | 24/230 A |
| 4,094,046 | 6/1978 | Takada | 24/230 AK |
| 4,137,611 | 2/1979 | Lindblad | 24/230 AL |
| 4,182,008 | 1/1980 | Pouget | 24/230 A |

*Primary Examiner*—Robert A. Hafer
*Assistant Examiner*—P. Polakowski
*Attorney, Agent, or Firm*—Frishauf, Holtz, Goodman and Woodward

[57] ABSTRACT

A seat belt buckle, in which a locking member is mounted in a channel-shaped base member and a tongue can be inserted between the base member and locking member and locked in engagement with a tongue engaging surface of the locking member, comprising first and second symmetrical guide holes formed in said base member, a slider movably disposed in the base member, a first guide member being movable in said first guide holes and urging said locking member, a second guide member penetrating said second guide holes and movable together with said slider through said second guide holes, a tensile coil spring coupling together said first and second guide members, and a button member for releasing said first guide member from its locking state.

3 Claims, 5 Drawing Figures

BUCKLE FOR SEAT BELT

BACKGROUND OF THE INVENTION

This invention relates to improvements in a seat belt buckle.

In the usual seat belt buckle, a tongue is inserted between a base member and a locking member and is locked in engagement with a tongue engaging surface of the locking member. In this arrangement, the tongue and tongue engagement surface must be reliably engaged with each other so that the tongue will not be released even if a large external force is applied to it. On the other hand, the tongue must be able to be released from the tongue engaging surface with a small force when it is desired to unlock the tongue.

To this end, the prior art seat belt buckle is provided with two different springs, one for biasing the locking member when the tongue is locked and the other for ejecting the tongue when unlocking the tongue.

In this case, however, the mechanism is rather complicated and comprises a large number of parts.

In addition, when unlocking the tongue, the locking member must be released while it sustains a strong urging force from the tongue. Therefore, a strong force is required to unlock the tongue.

SUMMARY OF THE INVENTION

The object of the present invention is to provide a seat belt buckle, which has a simple construction consisting of a reduced number of parts and requires a small force for releasing the tongue.

According to the invention, there is provided a seat belt buckle, in which a locking member is mounted in a channel-shaped base member and a tongue can be inserted between the base member and locking member and locked in engagement with a tongue engaging surface of the locking member, comprising first symmetrical guide holes each formed in each of opposite side portions of the base member and having a first guide member urging section and a first guide member releasing section; elongate symmetrical second guide holes each also formed in each of the opposite side portions of the base member; a slider movably disposed in the base member and having a tongue urging face; a first guide member penetrating and movable in the first guide holes and urging the locking member when in the first guide member urging sections; a second guide member penetrating the second guide holes and movable together with the slider through the second guide holes from one end to the other thereof and vice versa; a tensile coil spring coupled to the first and second guide members; and a button member having a releasing surface for urging the first guide member toward the first guide member releasing sections, wherein by inserting the tongue between the base member and locking member the slider moves the first guide member into the first guide member urging sections so as to urge the locking member for bringing the tongue into engagement with the tongue engaging surface of the locking member, and also by depressing the button member the first guide member is moved into the first guide member releasing sections to push the slider in the direction of releasing the engagement between the tongue and tongue engaging surface.

DETAILED DESCRIPTION OF THE PREFERRED EMBODIMENT

Figure 1:
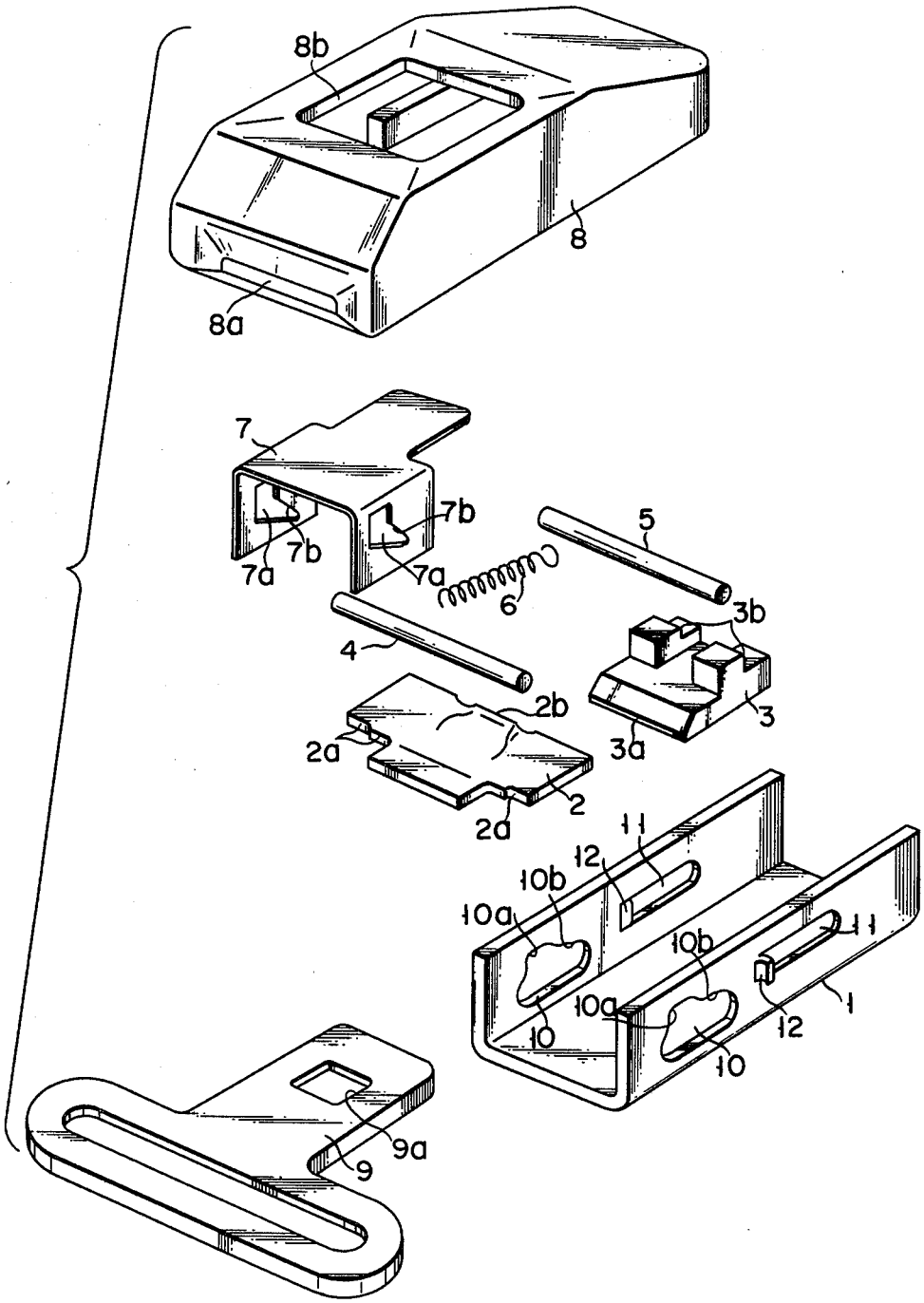
FIG. 1 is an exploded perspective view showing an embodiment of the seat belt buckle according to the invention.
Figure 2:
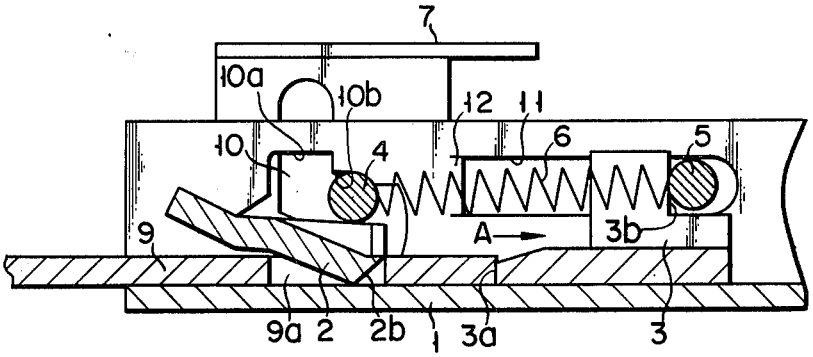
FIGS. 2 to 4 are respectively a sectional view, a side view and a sectional view for illustrating the operation of the seat belt buckle shown in FIG. 1.

Now, the invention will be described in detail in conjunction with a preferred embodiment thereof with reference to the drawings.

Referring to FIGS. 1–4, the seat belt buckle comprises a base member 1, in which a locking member 2, a slider 3, a rod-like first guide member 4, a rod-like second guide member 5, a tension coil spring 6 and a button member 7 are mounted. These parts are covered by a cover 8. A tongue 9 is inserted into the base member 1 covered by the cover 8 to be locked therein. The tongue 9 is released from the locked state by depressing the button member 7.

The base member 1 is a channel-shaped member. It has first guide holes 10 formed in each of its opposite side portions. It also has second guide holes 11 formed in each side portion. The first guide holes 10 are formed nearer the end of the base member 1, from which the tongue is inserted. The locking member is disposed such that it overlaps a lower portion of the first guide holes 10. Each of the first guide holes 10 has a first guide member releasing section **10*a* and a first guide member urging section 10*b* at a lower level than the section 10*a*. The first guide member urging section 10*b* has a height substantially equal to the sum of the thickness of the locking member 2 and the thickness of the first guide member 4. The first guide member releasing section 10*a* has a height greater than the height of the first guide member urging section 10*b*. The second guide holes 11 are elongated holes extending in the longitudinal direction of the base member 1. The base member 1 has outwardly projecting, button member receiving ears 12. These ears 12 are each provided between the associated first guide hole 10 and second guide hole 11**.

Figure 5:
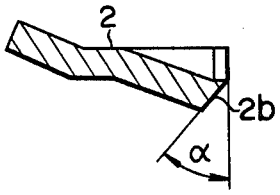
FIG. 5 is a sectional view showing a locking member of the same seat belt buckle.

The locking member 2, which is disposed to overlap a lower portion of the first guide holes 10 as mentioned above, is in the form of a substantially rectangular plate. It is rockable about its one end face. Its other end is formed with a tongue engaging face **2*b*. As shown in an enlarged scale in FIG. 5, the tongue engaging face 2*b*** is inclined and has an inclination angle $\alpha$ of 20° to 35° C.

The slider 3 is movable in the base member 1. It has a tongue pushing face **3*a* formed on its end facing the tongue engaging face 2*b* of the locking member 2. Its top is formed with a second guide member pushing portion 3*b*. The second guide pushing portion 3*b* serves to push the second guide member 5** away from the tongue insertion end.

The first guide member 4 penetrates the first guide holes 10 and is movable between the first guide member urging section **10*b* and first guide member releasing section 10*a* of each of the first guide holes 10. When the first guide member 4 is brought into the first guide member urging sections 10*b*, it urges the locking member 2 toward the base member 1 to prevent rocking of the locking member 2. On the other hand, the locking member 2 is allowed to rock when the first guide member 4 is brought to the first guide member releasing sections 10***a* of the guide holes 10.

The second guide member 5 penetrates the second guide holes 11, and its central portion is urged against the second guide member urging portion 3*b* of the slider 3.

The tension coil spring 6 is tied to the first and second guide members 4 and 5. The tension coil spring 6 serves to urge the first guide member 4 toward the second guide member 5 and also urge the second guide member 5 toward the first guide member 4. The button member is channel-shaped, and it has substantially rectangular holes 7*a* formed in its opposite side portions. The slanted edges of the holes 7*a* serve as a first guide member releasing face 7*b*. The button member 7 is disposed such that it engages the button member receiving ears 12. The first guide member 4 penetrates the holes 7*a* of the button member 7. When the button member 7 is depressed, the first guide member 4 is moved upwardly along the releasing face 7*b* of the button member 7 so that it is shifted from the first guide urging sections 10*b* to the first guide releasing sections 10*a* of the first guide holes 10.

The cover 8 is provided at the end with a tongue insertion opening 8*a* and at the top with a button member receiving opening 8*b*.

The tongue 9 has a hole 9*a*. It can be inserted between the base member 1 and locking member 2 through the tongue insertion opening 8*a* formed in the cover 8. It can be locked when its hole 9*a* engages the tongue engaging face 2*b* of the locking member 2.

With the seat belt buckle having the above construction, the tongue 9 can be locked and released in the following way.

Figure 4:
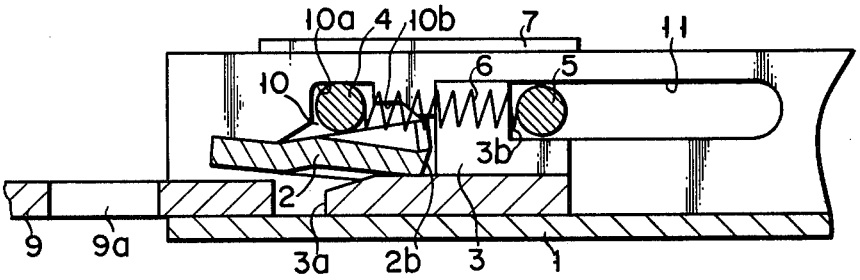

Before inserting the tongue 9, the second guide member 5 is found at the left end of the second guide holes 11, as shown in FIG. 4. In this state, the locking member 2 is held raised by the slider 3, and the first guide member 4 is found in the first guide member relasing sections 10*a* of the guide holes 10.

When the tongue 9 is inserted between the base member 1 and locking member 2, the slider 3 is pushed in the direction of arrow A by the tongue 9. With the movement of the slider 3 the second guide member 5 is also moved in the same direction. As the tongue 9 is further pushed into the base member 1, the hole 9*a* of the tongue 9 is brought to a position under the tongue engaging face 2*b* of the locking member 2. Meanwhile, the first guide member 4 is pulled in the direction of arrow A by the pulling force of the tension coil spring 6 so that it is displaced from the first guide member releasing sections 10*a* to the first guide member urging sections 10*b* of the first guide holes 10. As a result, the locking member 2 is pushed down so that its tongue engaging face 2*b* is brought into engagement with the hole 9*a* of the tongue 9. The tongue 9 is thus locked. When the tongue 9 is locked, the locking member 2 is urged by the first guide member 4. In this state, the locking member 2 is not released even if the tongue is strongly pulled. Further, the engagement between the tongue 9 and locking member 2 will not be released by an impact force exerted in any direction such as an impact force at the time of rapid deceleration.

Figure 3:
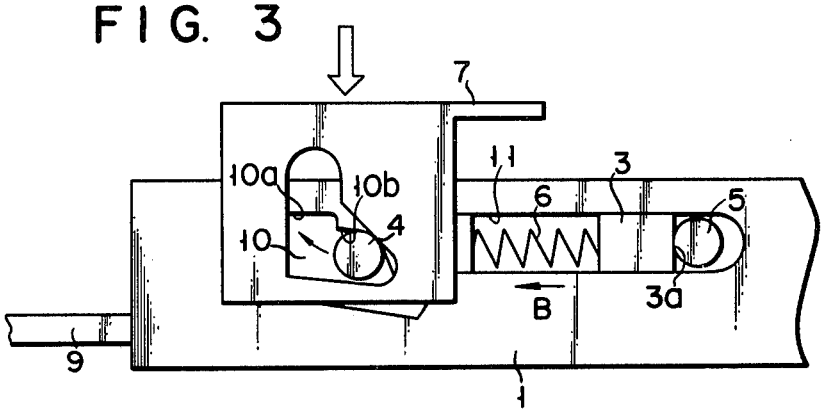

To release the tongue 9 from the locked state, the button member 7 is depressed as shown in FIG. 3. By depressing the button member 7, the first guide member 4 is moved upwards along the releasing face 7*b* into the first guide member releasing sections 10*a*. With this displacement of the first guide member 4, the locking member 2 is released from the locked state. As a result, the second guide member 5 and slider 3 are pulled in the direction of arrow B (opposite to the direction of arrow A) by the pulling force of the tension coil spring 6, thus pushing back the tongue 9 by raising the tongue engaging face 2*b* of the locking member 2. At this time, the displacement of the first guide member 4 into the first guide member releasing sections 10*a* may be brought about against the tensile force of the tension coil spring 6 and also against the force of friction between the first guide member 4 and base member 1, and there is no need to directly overcome the pulling force of the tongue 9. Thus, the tongue 9 can be readily released from the locked state by lightly depressing the button member 7. Further, since the tongue engaging face 2*b* is inclined by an angle of 20 to 35 degrees, as the tongue 9 is pushed back in the direction of arrow B, an upward force is produced to assist in releasing the engagement between the tongue engaging face 2*b* of the locking member 2*b* and hole 9*a* of the tongue 9. If the inclination angle is too small, the engagement cannot be readily released. If the inclination angle is too large, deformation of the tongue is likely.

With the seat belt buckle as described above, the tension coil spring serves to push back the tongue and also to urge the locking member to hold the tongue locked. In addition, the locking and unlocking of the tongue can be obtained with three parts, namely the tension coil spring, slider and button member. Thus, it is possible to simplify the construction and reduce the number of component parts.

Further, when releasing the tongue, it is only necessary to apply a force sufficient to overcome the tensile force of the tension coil spring and the force of friction between the first guide member and base member. Thus, the tongue can be released by lightly depressing the button member.

While in the above embodiment the slider 3 and second guide members 5 are provided as respective separate component parts, this is by no means limitative, and the slider 3 and second guide member 5 may be replaced with a one-piece member.

What is claimed is:

1. A seat belt buckle, in which a locking member is mounted in a channel-shaped base member and a tongue can be inserted between the base member and locking member and locked in engagement with a tongue engaging surface of the locking member, comprising first symmetrical guide holes each formed in each of opposite side portions of said base member and having a first guide member urging section and a first guide member releasing section; elongated symmetrical second guide holes each also formed in each of said opposite side portions of said base member; a slider movably disposed in the base member and having a tongue urging face; a first guide member penetrating and movable in said first guide holes and urging said locking member when in said first guide member urging sections; a second guide member penetrating said second guide holes and movable together with said slider through said second guide holes from one end to the other thereof and vice versa; a tensile coil spring coupled to said first and second guide members; and a button member having a releasing surface for urging said first guide member toward said first guide member releasing sections; said slider being movable, with the insertion of said tongue between said base member and locking member, to move said first guide member into said first guide member urging sections so as to urge said locking member to bring said tongue into engagement with said tongue engaging surface of said locking member, said first guide member being movable into said first guide member releasing sections, with the depression of said button member, to push said slider in the direction of releasing the engagement between said tongue and tongue engaging surface.

2. The seat belt buckle according to claim 1, wherein said tongue engaging surface of said locking member has an inclination angle $\alpha$ of 20 to 35 degrees.

3. The seat belt buckle according to claim 1, wherein said second guide member is integral with said slider.

* * * * *